United States Patent [19]

Kuzuya

[11] Patent Number: 4,585,224

[45] Date of Patent: Apr. 29, 1986

[54] PAPER FEEDING APPARATUS

[75] Inventor: Susumu Kuzuya, Nagoya, Japan

[73] Assignee: Brother Kogyo Kabushiki Kaisha, Nagoya, Japan

[21] Appl. No.: 602,188

[22] Filed: Apr. 19, 1984

[30] Foreign Application Priority Data

May 6, 1983 [JP] Japan ..... 58-68388[U]
May 7, 1983 [JP] Japan ..... 58-68177[U]

[51] Int. Cl.[4] ..... B65H 5/16

[52] U.S. Cl. ..... 271/127; 271/160; 271/162; 271/170; 400/551; 400/624; 400/625; 400/629

[58] Field of Search ..... 271/127, 160, 162, 163, 271/164, 170, 114, 116; 400/620, 551, 624, 625, 629; 188/82.6

[56] References Cited

U.S. PATENT DOCUMENTS

| | | | |
|---|---|---|---|
| 3,652,083 | 3/1972 | Bosshardt | 271/39 |
| 3,776,545 | 12/1973 | White | 271/116 |
| 3,837,441 | 9/1974 | Uno et al. | 188/82.6 |
| 4,084,805 | 4/1978 | Simpson | 271/9 |
| 4,157,822 | 6/1979 | Miller | 271/3.1 |
| 4,268,021 | 5/1981 | Rutishauser et al. | 271/116 |
| 4,386,864 | 6/1983 | Wang et al. | 400/625 |

OTHER PUBLICATIONS

IBM Technical Disclosure Bulletin, Hopper Mechanism by T. C. Binkhuysen, vol. 17, No. 1, Jun. 1974, pp. 147 and 148.

*Primary Examiner*—Bruce H. Stoner, Jr.
*Assistant Examiner*—John A. Carroll
*Attorney, Agent, or Firm*—Moonray Kojima

[57] ABSTRACT

A paper feeding apparatus for a printing device, comprising a rotational shaft connected through a one way spring clutch to a forward and reverse rotatable driving motor supported by the printing device, feed rollers mounted on the rotational shaft so as to be in pressure contact with the uppermost surface of pieces of printing paper stacked on a holder table, and a coil spring wound around the rotational shaft and supported at one end thereof by a frame for preventing the rotation in the other direction of the rotational shaft induced by the reverse rotation of the driving motor. The holder table is supported by the frame pivotally through an adjusting means utilizing an eccentric shaft.

3 Claims, 7 Drawing Figures

PAPER FEEDING APPARATUS

BACKGROUND OF THE INVENTION.

1. Field of Invention

This invention relates to a paper feeding apparatus, and more particularly to such apparatus using a holder table for holding pieces of paper stacked thereon and feed rollers for feeding the pieces of paper one by one to the platen of a printing device.

2. Description of the Prior Art

Usually, in the foregoing type of apparatus, the motor for driving the feed rollers also functions to rotate the platen, and a spring clutch is interposed between the motor and the feed rollers, to transmit to the feed rollers only the rotation in the paper feed direction. Moreover, for printing on a new piece of paper, the motor is rotated forwardly by a predetermined amount. This forward rotation is transmitted to the feed rollers and the platen. As a result the uppermost paper sheet on the holder table is fed to the platen side and set at a predetermined printing start position on the platen. Thereafter printing is started with depression of keys and the motor is rotated forwardly at each printing line to effect changing of lines.

The motor is sometimes rotated reversely for the purpose of correction and hence the platen is reverse-rotated, so that printing paper on the platen is fed in the direction opposite to the paper feeding direction. In this case, the reverse rotation of the motor should be cut off by the spring clutch and should not be transmitted to the feed rollers. But, in case the load, acting on the feed rollers against the reverse rotation, is small, the feed rollers may be rotated reversely. (Detailed reasons for this action will be discussed hereinafter.)

If there occurs such reverse rotation of the feed rollers, the uppermost printing paper sheet, or, as the case may be, both the uppermost sheet and the printing paper next in line, are retreated from the paper feed start position, so that the next paper feed is started from this retreated position. Therefore, the fed printing paper is set at a position before reaching the predetermined printing start position on the platen. Consequently, printing for the paper is started from a position different from the printing start position on the other printing papers, or printing may be started before the front end of the paper reaches the printing position.

In this type of paper feed apparatus, moreover, the plurality of feed rollers are rotatably supported by the frame of the apparatus. The holder table, for holding stacked paper, is also pivotally supported by the frame. The holder table is urged so that the upper surface of the uppermost sheet of paper thereon is kept in pressure contact with the feed rollers, and the paper sheets are fed one by one with rotation of the feed rollers.

The foregoing type of paper feeding apparatus, however, is disadvantageous, since the frame is formed integrally by molding and tends to become distorted at its end portions. Consequently, the pivotal axis of the holder table and the axis of rotation of the feed rollers are no longer disposed on the same plane, and are not properly aligned. Accordingly, the uppermost paper sheet on the holder table is no longer kept at constant uniform pressure contact with the feed rollers. This would tend to impede proper paper feeding operation.

SUMMARY OF THE INVENTION

Accordingly, an object of the invention is to improve the prior art, and to overcome the aforementioned and other disadvantages and deficiencies of the prior art.

Another object is to provide a paper feeding apparatus for a printing device, which is capable of preventing sheets of printing paper from retreating on the holder table.

A further object is to provide a paper feeding apparatus which permits easy adjustment of the pivotal axis of the holder table.

The foregoing and other objects are attained by the invention which encompasses a paper feeding apparatus for a printing device having a paper feed mechanism, and comprising a frame supported by the printing device; a driving motor for driving the paper feed mechanism; a rotational shaft supported rotatably by the frame and adapted to be driven through a one way spring clutch in accordance with a forward rotation of the driving motor; feed rollers supported on the rotational shaft; a holder table for holding thereon stacked pieces of paper to be delivered by the feed rollers with rotation in one direction of the rotational shaft; and a coil spring wound onto the rotational shaft and fixed at one end thereof onto the frame, the coil spring being adapted to come into close contact with the surface of the rotational shaft when the rotational shaft tries to rotate in the other direction in accordance with reverse rotation of the driving motor, thereby preventing the rotation of the rotational shaft.

In another embodiment, the paper feeding apparatus comprises a frame; feed rollers rotatably supported on the frame; a plate-like holder table for holding stacked pieces of paper thereon, the holder table being urged toward the feed rollers; a pair of support means for supporting both right and left side portions of the holder table pivotally about an axis substantially parallel to the axis of rotation of the feed rollers with respect to the frame; and an adjusting means provided on at least one of the support means for adjusting the position of the pivotal center of the holder table relative to the frame.

DETAILED DESCRIPTION OF PREFERRED EMBODIMENTS

Figure 1:
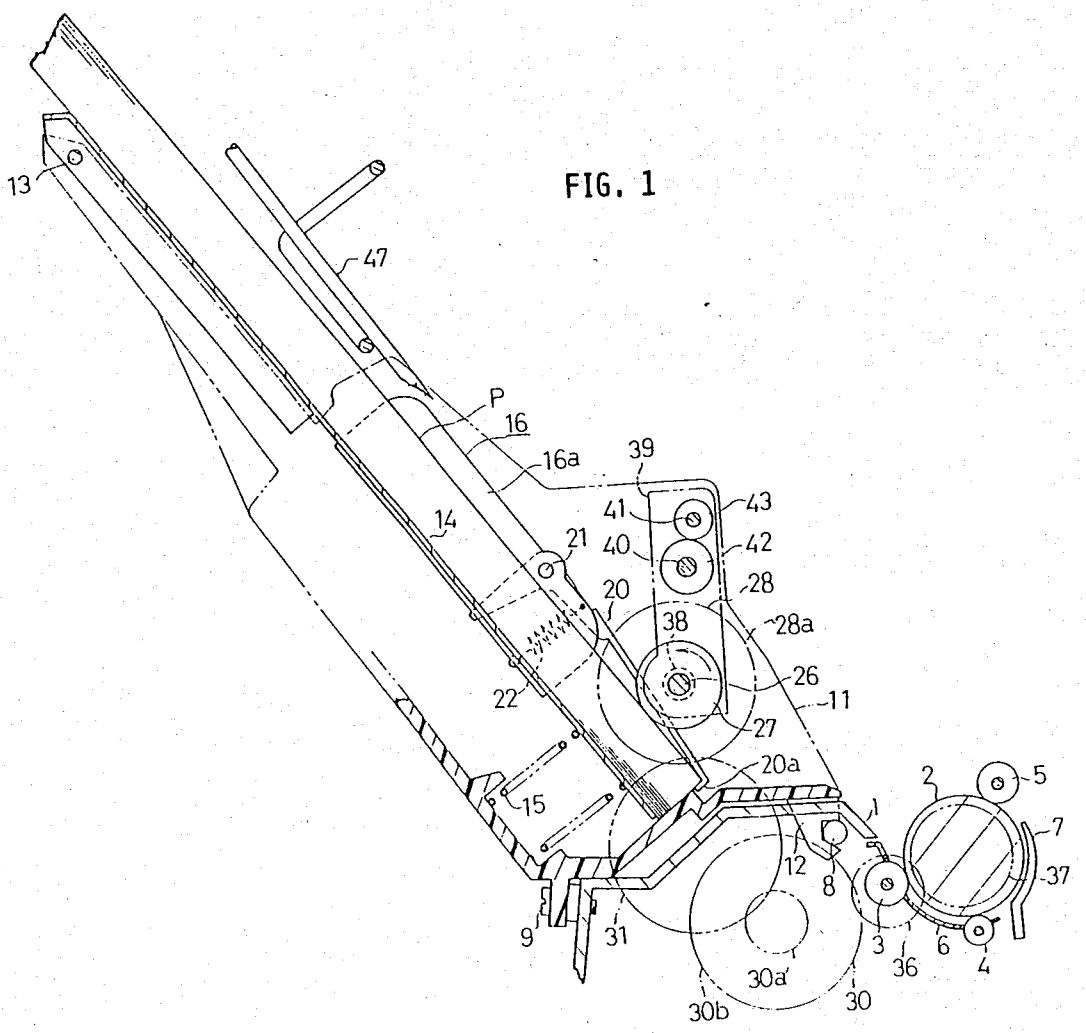
FIG. 1 is a sectional side view depicting an illustrative embodiment of the invention.

Turning now to FIG. 1, there is depicted a paper feed apparatus, wherein onto the upper portion of a frame 1, of a printing device having a platen 2, is fixed a resinous frame 11 of a paper feeding apparatus through engagement between a pin 8, provided on the printing device side, and a mounting leg 12 provided on the paper feed apparatus. Guide rollers 3,4,5 guide paper P in cooperation with platen 2. A paper pan 6 and a paper meter 7 are disposed about platen 2.

Figure 2:
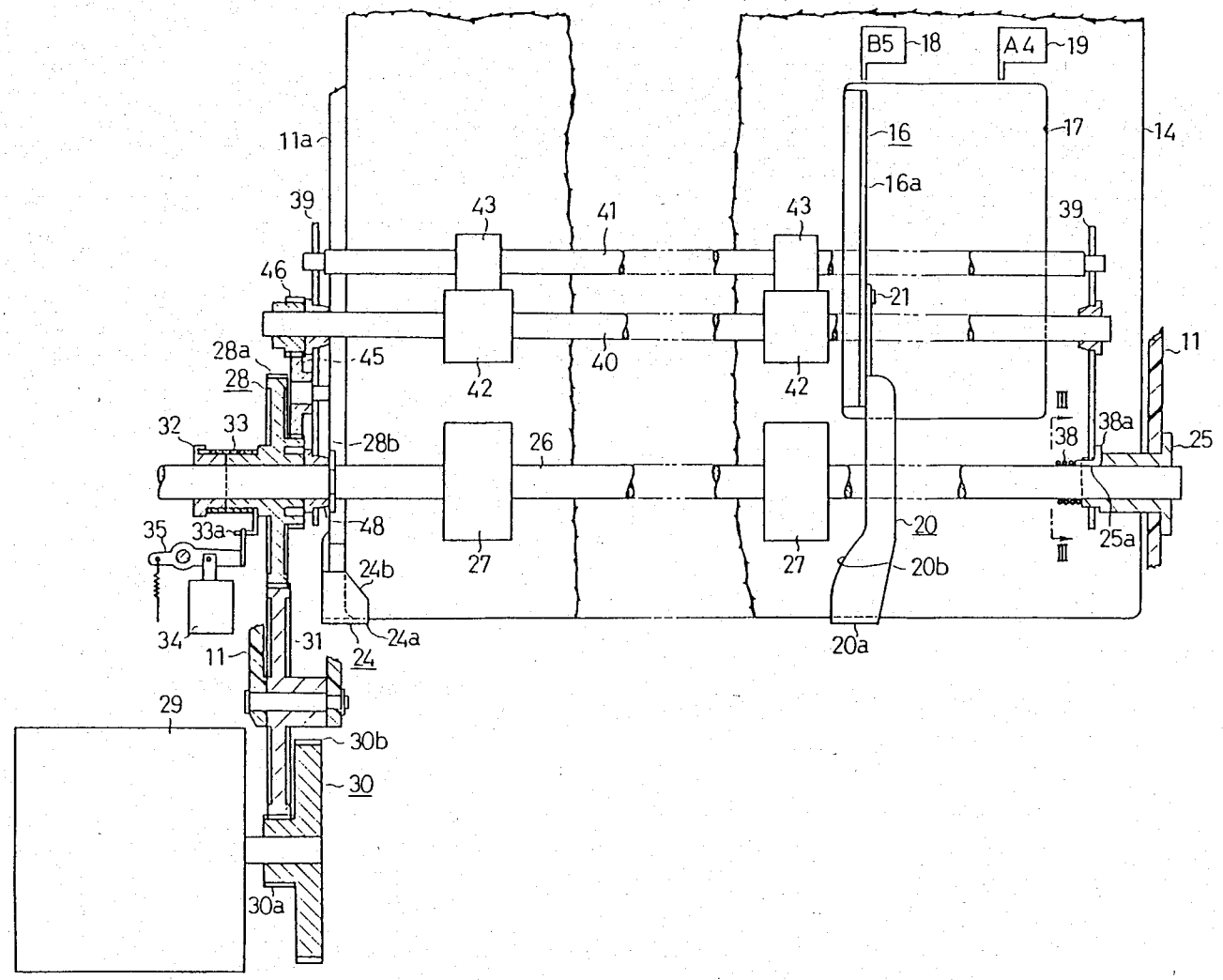
FIG. 2 is a front view depicting the embodiment of FIG. 1 partly in section.

A holder table 14 is supported by frame 11 pivotally at its upper end portion through a shaft 13. Holder table 14 is urged by a spring 15. On holder table 14 are placed and held a large number of pieces, such as sheets, of printing paper P in a stacked state. As shown in FIGS. 1 and 2, an opening 17 is formed on one side of holder table 14. On the back side of holder table 14, a restriction plate 16 is supported by frame 11. Restriction plate 16 has a bent portion 16*a* on one side thereof, bent portion 16*a* projecting forwards through opening 17. Restriction plate 16 is manually adjustable for movement to the left and right. In the left or right position, thus adjusted, it arranges in order and guides paper P in cooperation with one side portion 11*a* of frame 11. Indexes 18 and 19 are provided for indicating the size of the paper P.

Pawl members 20 and 24 are pivotally supported, respectively, to bent portion 16*a* of restriction plate 16 and one side portion 11*a* of frame 11. They are bent at the respective end portions to form pawl portions 20*a* and 24*a*, which are opposed to the ends of stacked papers P. Further, the inside edge of the portion of one pawl member 20 supported by restriction plate 16 is formed as an arcuate edge 20*b*. The inside edge of the portion of the other pawl member 24, supported by the frame 11, is formed as an oblique and linear edge 24*b*. In the drawings, one pawl member 20 is supported by bent portion 16*a* of restriction plate 16, pivotally, through a shaft 21. Its pivoting range is restricted by a restriction means (not shown) formed at a part of restriction plate 16. Pawl member 20 is urged by a spring 22 so that its end portion is pressed toward paper P. This is used for allowing the end portion of pawl member 20 to lie along the uppermost paper regardless of the pivotal position of holder table 14 and the thickness of stacked papers P. The other pawl member 24 has a support structure for frame 11 which is substantially similar.

In front of holder table 14, a feed shaft 26 as a rotational shaft, is supported by frame 11 rotatably through right and left bearings 25 (on the right bearing is shown for clarity of description). Onto feed shaft 26 are fixed a pair of right and left feed rollers 27. The uppermost printing paper P on holder table 14 is brought into contact with the peripheral surfaces of both feed rollers 27 by the biasing force of spring 15. When feed rollers 27 are rotated in the direction of arrow (unnumbered) in FIG. 1, a feed force is imparted to the uppermost sheet of paper P, so that the paper is brought into pressure engagement at both sides of its front end with the inside surfaces of pawl portions 20*a* and 24*a* of both pawl members 20 and 24.

Figure 5:
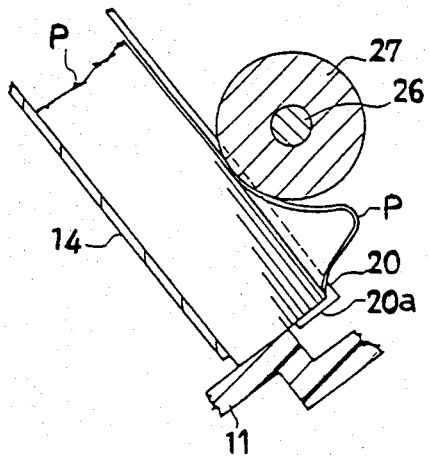
FIG. 5 is a sectional view taken along line V—V of FIG. 4.
Figure 4:
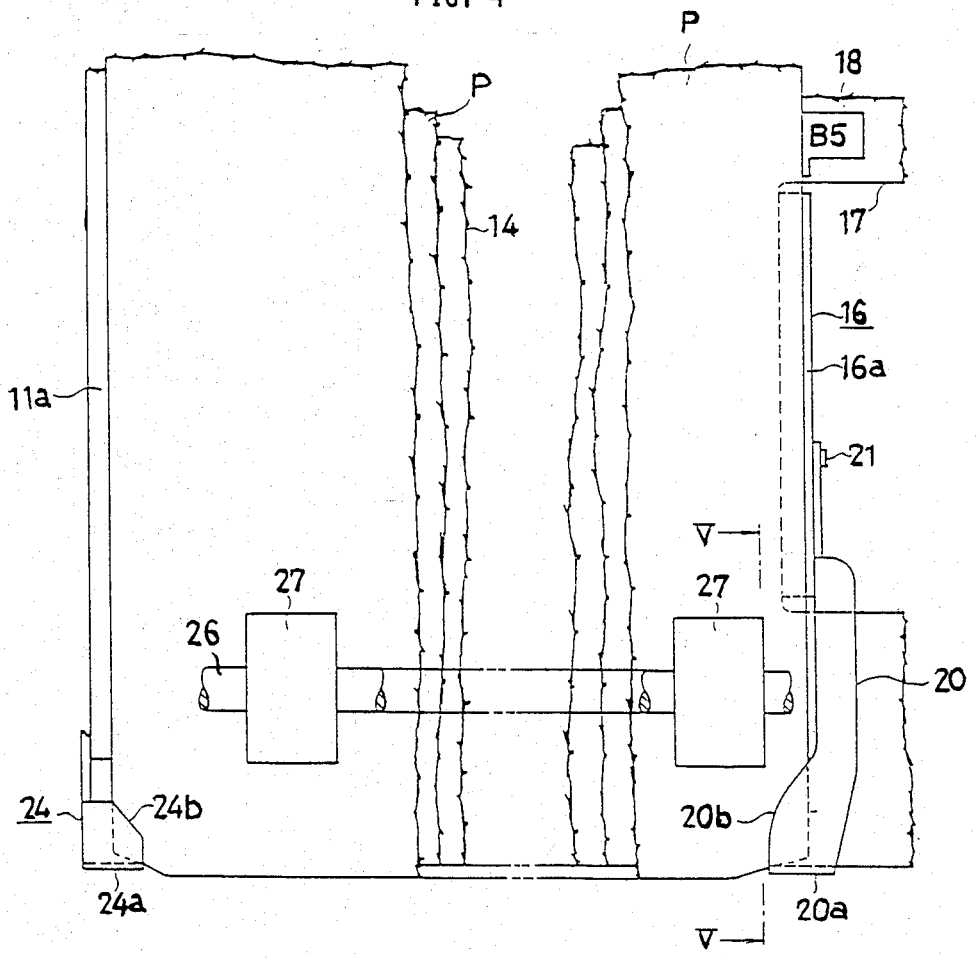
FIG. 4 is a front view depicting a paper feed starting condition.

In this manner, as shown in FIGS. 4 and 5, both side portions of the front end of the uppermost sheet of paper P are bent upwards between feed rollers 27 and pawl members 20 and 24 and are released from the state of close contact with the underlying printing paper P. With subsequent rotation of the feed rollers 27 in the arrowed direction, both side portions of the front end of the uppermost paper sheet P are disengaged from pawl portions 20*a* and 24*a* of pawl members 20 and 24 and fed in a front lower direction.

A shown in FIG. 2, actuating gear 28, which comprises integrally formed gear portion 28*a* of a large diameter and gear portion 28*b* of a small diameter, is rotatably mounted on the leftmost portion of feed shaft 26. Onto feed shaft 26 is further fixed a sleeve 32 in a position adjacent to actuating gear 28. Between actuating gear 28 and sleeve 32 is interposed a one-way spring clutch 33, which comprises a coil spring. The rotation of motor 29, as a power source supported by frame 1, is transmitted to actuating gear 28 through a driving gear 30 and an intermediate gear 31.

As actuating gear 28 is rotated in the forward direction with the forward direction of rotation of motor 29, a solenoid 34 is energized and actuating pawl 35 is disengaged from a bent portion 32, formed at one end of spring clutch 33, whereupon clutch 33 is engaged tightly (that is rolled) so that actuating gear 28 and sleeve 32 are rotated integrally. As a result, feed shaft 26, having feed rollers 27, is rotated in the paper feed direction.

On the other hand, when solenoid 34 is de-energized during the forward direction of rotation of motor 29, and actuating pawl 35 is positioned within the range of engagement with bent portion 33*a* at one end of spring clutch 33, clutch 33 is loosened, that is disengaged, so that the connection between actuating gear 28 and sleeve 32, is released and the transmission of rotation to feed shaft 26 is thereby cut off. Also, when motor 29 rotates in the reverse direction of rotation, the spring clutch 33 is loosened to cut off the transmission of rotation.

As is apparent from FIG. 1, large diameter gear portion 30*b*, of driving gear 30, is connected through an intermediate gear 36, to a driven gear 37, which is coaxial with platen 2, whereby the rotation of motor 29 is transmitted also to platen 2.

Figure 3:
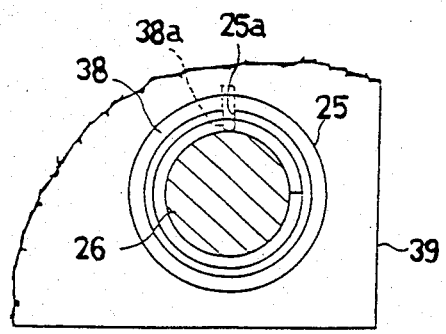
FIG. 3 is a sectional view taken along line III—III of FIG. 2.

As shown in FIGS. 2 and 3, a coil spring 38 is wound around the rightmost portion of feed shaft 26, and a bent portion 38*a* which is formed at one end of coil spring 38, is fitted and fixed into a retaining groove 25*a* which is formed in right bearing 25. When a rotating force in paper feed direction is imparted to feed shaft 26, coil spring 38 is loosened. On the other hand, when a rotating force in a direction opposite to the paper feed direction, is imparted thereto, coil spring 38 comes into close contact with the outer peripheral surface of feed shaft 26 thereby to prevent shaft 26 from rotating in the direction reverse to the paper feed direction.

Support frames 39 are pivotally mounted on bearing 25 and a collar 48 on feed shaft 26, and support shafts 40 and 41 are supported rotatably by support frame 39. Support shafts 40 and 41 are provided with a pair of right and left draw out rollers 42 and a pair of right and left draw out rollers 43, respectively. A driven gear 46 is fixed to an end portion of support shaft 40. It is connected to small diameter gear portion 28*b* of actuating gear 28 through an intermediate gear 45. The rotation of actuating gear 28 is transmitted to support shaft 40. With rotation of shaft 40, paper P, after printing, which has been delivered from platen 2, is moved toward a holder frame 47 on frame 11 while being held between draw out rollers 42 and 43. As support frames 39 pivot forward or backward about feed shaft 26, draw out rollers 42 and 43 are brought into drawing out positions or refuge positions spaced therefrom.

Figure 6:
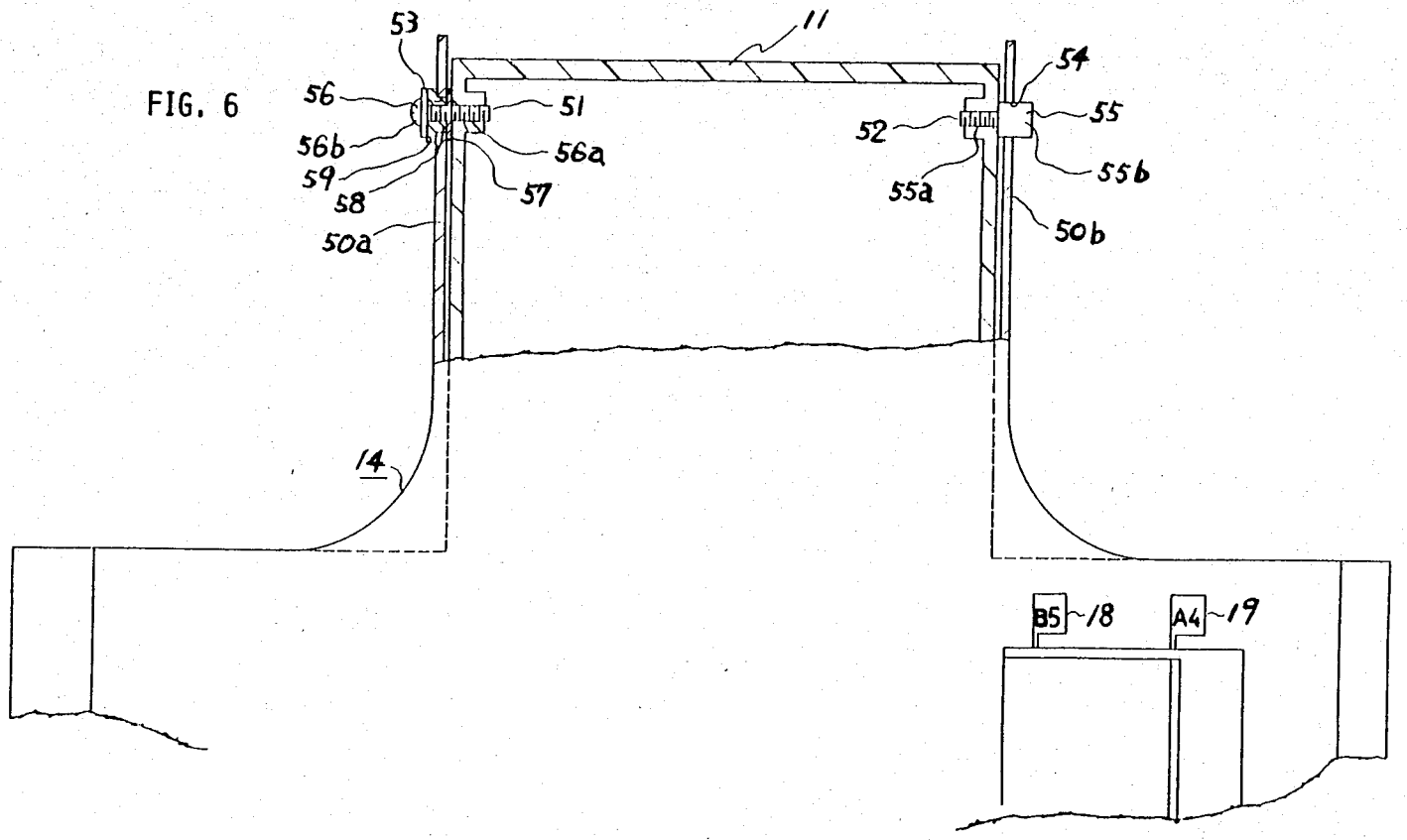
FIG. 6 is an enlarged front view depicting the embodiment of FIG. 1, and shown with the holder table exposed after removal of paper.
Figure 7:
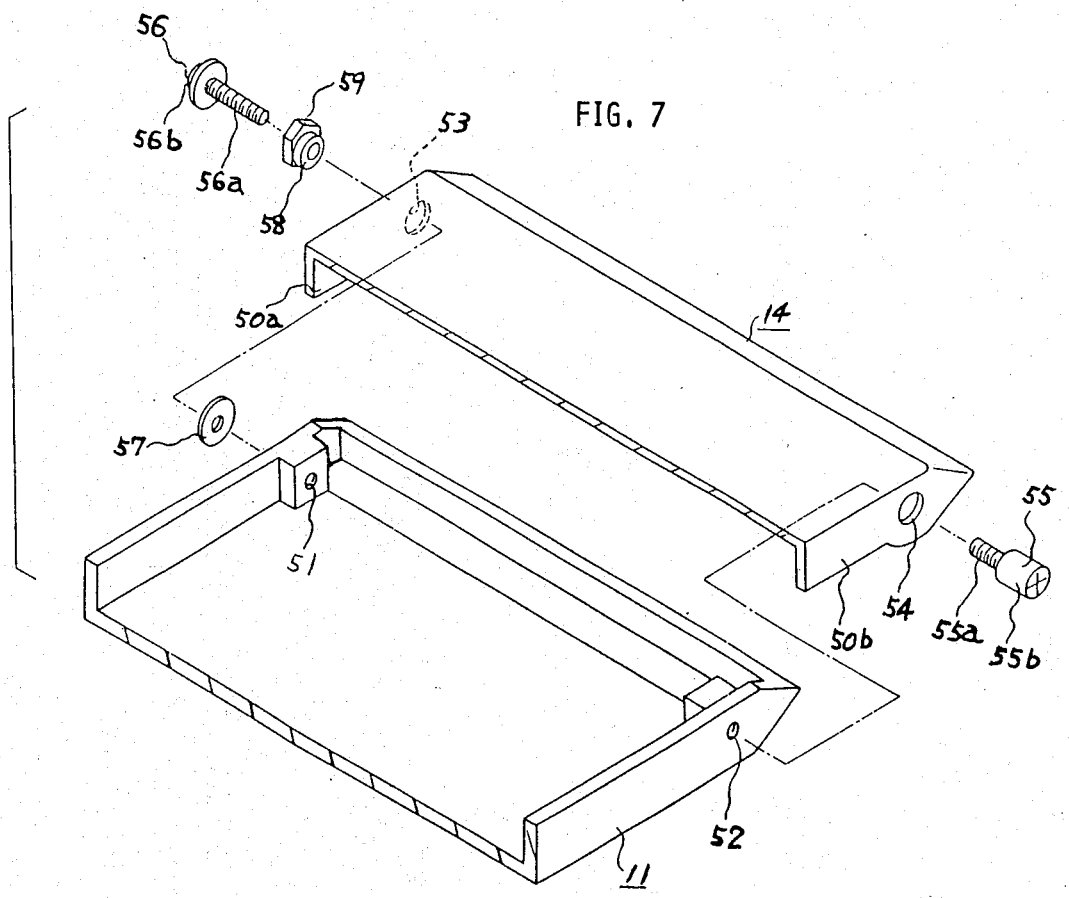
FIG. 7 is an exploded perspective view depicting a support structure for the holder table.

The structure for supporting holder table 14 with respect to frame 11 will now be described with reference to FIGS. 6 and 7. Holder table 14, which comprises a metal plate, is disposed on frame 11. Both left and right side edges of the upper portion of holder table 14 are bent to form bent walls 50*a* and 50*b*, which are disposed on both left and right sides of the upper portion of frame 11. On both sides of the upper end portion of frame 11 are formed a pair of left and right mouting holes 51 and 52, which are positioned on an axis substantiaily parallel to the axis of feed rollers 27.

A pair of shaft holes 53 and 54 are formed in the upper end portions of bent walls 50*a* and 50*b* in an opposed corresponding relation to mounting holes 51 and 52. A support shaft 55 which comprises a screw portion 55*a* and a shaft portion 55*b* is fitted at its screw portion 55*a* threadedly into mounting hole 52 and inserted at its shaft portion 55*b* into the right shaft hole 54, whereby the right bent wall 50*b* of holder table 14 is pivotally supported by frame 11.

Further, a screw 56 is provided which comprises a screw portion 56*a* and a head portion 56*b*. The screw portion 56*a* is threadedly fitted in left mounting hole 51. Its intermediate portion is inserted in left shaft hole 53 formed in left bent wall 50*a*. The head portion 56*b* is positioned outside bent wall 50*a*. Between the left bent wall 50*a* and frame 11, a spacer 57 is fitted on screw portion 56*a* of screw 56. Furthermore, between spacer 57 and head portion 56*b* of screw 56, eccentric shaped shaft 58, which serves as an adjusting means, is fitted on screw portion 56*a*, so that the inner peripheral surface of left shaft hole 53 of table 14 engages the outer peripheral surface of shaft 58. In this manner, left bent wall 50*a* is pivotally supported by frame 11. A flange 59 is formed integrally on left side face of eccentric shaft 58. Flange 59 is disposed between head portion 56*b* of screw 56 and left bent wall 50*a*.

In case frame 11 which is preferably molded of a synthetic resin undergoes shrinkage or expansion, and consequently the axis of mounting holes 51 and 52 and pivot axis of feed rollers 27 are no longer aligned in the same plane, simple adjustment of the screws will again align the holes with the axis. For example, left shaft hole 53 of holder table 14 can be deviated from mounting hole 51 by slightly loosening screw 56 in the state shown in FIG. 1, and then, pivotally adjusting the eccentric shaft 58 with flange 59. After that screw tightened again. Thus, by displacing the axis of shaft holes 53 and 54 of table 14 (i.e. the pivot axis of table 14), it is possible to move the axis to the same plane as the pivot axis of feed rollers 27. Consequently, during the foregoing paper feeding operation, paper P on holder table 14 can be brought into a uniform pressure contact with both feed rollers 27 and a smooth paper feeding operation is thereby insured.

When motor 29 is rotated in the forward direction, spring clutch 33 and feed rollers 27 are rotated in the paper feed direction, upon operation of spring clutch 33, so that the sheets of printing paper P stacked and held on holder table 14, are separated successively from the uppermost one by means of pawl members 20 and 24 and delivered one by one to platen 2. In this case, since feed shaft 26 rotates in the direction in which coil spring 38 is loosened, its smooth rotation is insured without any influence on its rotation in the paper feed direction.

When motor 29 is rotated in the reverse direction of rotation, the rotation is transmitted through driving gear 30 and intermediate gear 31 onto actuating gear 28 mounted on feed shaft 26. At this time, since the rotation is in the direction in which spring clutch 33 is loosened, the rotation will not be transmitted to feed shaft 26. But, in case the load resisting the reverse direction of rotation, which acts on feed shaft 26, is smaller than the force for loosening spring clutch 33, against the spring force of the latter, spring clutch 33 will not be loosened. In that case, feed shaft 26 receives a rotational force acting in the direction opposite to that of the feed direction. However, the action of such rotational force in the reverse direction on feed shaft 26 in coil spring 38 on feed shaft 26 being immediately rolled tightly and coming into close contact with the outer peripheral surface of feed shaft 26 to prevent the latter from being rotated. Consequently, printing paper P which is in contact with feed rollers 27, is prevent from being retreated, and the subsequent delivery or feeding of paper P can be started always from the predetermined position. In other words, the printing of new printing paper P can be started accurately in the predetermined position. Advantageously, this can be attained by the provision of only one coil spring 38.

Furthermore, advantageously, since feed shaft 26 is thus kept unrotatably, spring clutch 33 is loosened and the connection between actuating gear 28 and sleeve 32 is released. Hence, actuating gear 28 is rotated independently of feed shaft 26 and the rotation of each gear is not impeded at all, thereby causing no obstacle to the reverse feed of paper P on platen 2.

In the embodiment, moreover, edge 20*b* of pawl member 20, attached to restriction plate 16, is in a slightly bulged arcuate form, so that in the case where printing paper P is fed in an adjacent state of pawl member 20 with respect to right feed roller 27, it is possible to prevent paper P from being bent at its right front end portion. In case paper P, stacked on table 14, is of a small width, it is only necessary to move restriction plate 16 toward right feed roller 27, to arrange in order and guide, such narrow paper P. Such an arrangement of restriction plate 16, adjacent to feed roller 27 inevitably results in a narrowed spacing between the right pawl member 20 and right feed roller 27. Even in such a case, the amount of feed by feed roller 27 is constant. Thus, as is apparent from FIG. 5, the front end portion of paper P between feed roller 27 and pawl member 20, will be largely bent upwards as compared with the case where the spacing between feed roller 27 and pawl member 20 is wide. In such a case, if edge 20*b* of right pawl member 20 were in a linear form like the edge 24*b* of left pawl member 24, paper P would be creased linearly along its edge. However, it actually is impossible that a curved crease will be formed on the paper. Thus, in the presence of the curved edge 20*b*, paper P will not be creased along the curved edge 20*b* and thus can be prevented from becoming unsightly in appearance.

The foregoing description is illustrative of the principles of the invention. Numerous modifications and extensions thereof would be apparent to the worker skilled in the art. All such modifications and extensions are to be considered to be within the spirit and scope of the invention.

What is claimed is:

1. A paper feeding apparatus comprising a frame;

feed rollers supported pivotally on said frame;

a plate like holder table for holding stacked pieces of printing paper thereon, said holder table being urged toward said feed rollers at all times;

a pair of support means for supporting right and left side portions of said holder table pivotally about an axis substantially parallel to the axis of rotation of said feed rollers, relative to said frame; and adjusting means for adjusting the position of pivot center of said holder table relative to said frame, said adjusting means being attached to at least one of said support means, wherein said adjusting means comprises an eccentric shaft.

2. A paper feeding apparatus for a printing device having a paper feed mechanism, comprising a frame supported by said printing device;

a driving motor for driving said paper feed mechanism;

a rotational shaft supported rotatably by said frame;

feed rollers mounted on said rotational shaft; and a holder table for holding thereon stacked pieces of printing paper so as to be fed by said feed rollers upon rotation in one direction of said rotational shaft;

wherein said driving motor is supported by a frame of said printing device and is connected to said paper feed mechanism through a first transmitting mechanism and further connected to said rotational shaft through a second transmitting mechanism;

wherein said holder table is supported at both left and right side portions thereof pivotally by said frame and is urged by an urging member so that the uppermost surface of said papers stacked thereon is kept in pressure contact with said feed roller;

wherein said holder table further comprises an adjusting means for adjusting the position of pivot center of said holder table relative to said frame, said adjusting means being provided between said holder table and said frame; and wherein said adjusting means comprises an eccentric shaft.

3. The apparatus of claim 2, wherein said frame is formed of a resin.

* * * * *